US005995788A

United States Patent [19]

Baek

[11] Patent Number: 5,995,788

[45] Date of Patent: Nov. 30, 1999

[54] REFILL CARTRIDGE FOR PRINTER AND INK REFILL APPARATUS ADOPTING THE SAME

[75] Inventor: Chung-kuk Baek, Suwon, Rep. of Korea

[73] Assignee: Samsung Electronics Co., Ltd., Kyungki-do, Rep. of Korea

[21] Appl. No.: 09/097,806

[22] Filed: Jun. 16, 1998

[30] Foreign Application Priority Data

Jan. 31, 1998 [KR] Rep. of Korea ..... 98-2632

[51] Int. Cl.[6] ..... G03G 15/10

[52] U.S. Cl. ..... 399/238; 222/325; 141/320

[58] Field of Search ..... 399/238, 262, 399/263; 222/DIG. 1, 82, 325, 333, 372; 141/319–321, 329, 330, 351; 366/194–196, 270; 347/86; 101/DIG. 34

[56] References Cited

U.S. PATENT DOCUMENTS

| | | | |
|---|---|---|---|
| 3,876,282 | 4/1975 | Schon et al. | 399/238 |
| 4,126,250 | 11/1978 | Gram | 222/242 |
| 4,561,567 | 12/1985 | Wittstein et al. | 222/83.5 |
| 5,208,637 | 5/1993 | Landa | 399/120 |
| 5,248,847 | 9/1993 | Aoyama | 399/238 |
| 5,345,297 | 9/1994 | Katakabe et al. | 399/263 |
| 5,359,356 | 10/1994 | Ecklund | 347/86 |
| 5,435,461 | 7/1995 | Smith et al. | 222/45 |
| 5,595,223 | 1/1997 | Hayao | 141/375 |

FOREIGN PATENT DOCUMENTS

| | | |
|---|---|---|
| 6-234222 | 8/1994 | Japan . |
| 9-048109 | 2/1997 | Japan . |

*Primary Examiner*—Robert Beatty

*Attorney, Agent, or Firm*—Sughrue, Mion, Zinn, Macpeak & Seas, PLLC

[57] ABSTRACT

A refill cartridge for a printer and an ink refilling apparatus adopting the same. The refill cartridge includes a case having an ink supply outlet and an air hole, a shaft rotatably supported within the case, a propeller installed on the shaft for discharging ink contained in the case to the ink supply outlet, a shaft driving device for rotating the shaft, and an ink supply outlet plug for opening and closing the ink supply outlet.

17 Claims, 3 Drawing Sheets

REFILL CARTRIDGE FOR PRINTER AND INK REFILL APPARATUS ADOPTING THE SAME

BACKGROUND OF THE INVENTION

1. Field of the Invention

The present invention relates to a wet electrophotographic printer, and more particularly, to a refill cartridge for a printer having an improved structure to enable ink to be rapidly supplied to an ink cartridge placed in a main body of the printer, and an ink refill apparatus adopting the same.

2. Description of the Related Art

In general, a laser printer for a computer or printer applied to a copy machine adopts either a dry developing method using a powdered toner or a wet developing method using a developer liquid obtained by mixing toner with a liquid carrier. Both methods involve electrophotography in which a charged toner or developer liquid is transferred onto a photosensitive medium having a latent static image, and then a paper is passed between a transfer medium rotating in contact with the photosensitive medium, thereby printing an intended image onto a recording paper.

In a conventional electrophotographic printer, ink is supplied to a developing unit via an ink cartridge installed below the developing unit, so it is difficult to allocate the internal space of a printer. That is, the location of the developing unit is limited to a position near the photosensitive belt, so that the location of the ink cartridge is also limited in consideration of the volume of the ink cartridge, replacement and supplementation of ink, cleaning and repairing thereof.

Based on the above considerations, an ink supplying method, in which an ink cartridge is fixed to a position without limitations on the installation space, and in which ink is provided to the ink cartridge using an extra refill cartridge, can be adopted. According to this method, only the refill cartridge is replaced without replacing functional parts normally stored in the ink cartridge, such as a mixer, a dripless valve, an air hole and installation/detachment equipment, thereby lowering the manufacturing costs.

However, when using the refill cartridge, it takes a long time to inject ink into the ink cartridge, so a user must also wait for a long time.

SUMMARY OF THE INVENTION

To solve the above problems, it is an objective of the present invention to provide a refill cartridge for a printer, whose structure is improved so as to enable ink within the refill cartridge to be rapidly supplied to an ink cartridge.

It is another object of the present invention to provide an ink refill apparatus for a printer, which is capable of rapidly refilling an ink cartridge with ink using the refill cartridge.

To achieve the first objective, there is provided a refill cartridge for a printer comprising: a case having an ink supply outlet and an air hole; a shaft rotatably supported within the case; a propeller installed on the shaft, for discharging ink contained in the case to the ink supply outlet; means for rotating the shaft; and an ink supply outlet plug for opening and closing the ink supply outlet.

Preferably, the means for rotating the shaft comprises a driven clutch installed at one end of the shaft.

Preferably, the ink supply outlet plug comprises a coupling part coupled with the ink supply outlet, and a puncturable seal part attached to the coupling part.

Preferably, the refill cartridge further comprises an air hole plug for opening and closing the air hole.

To achieve the second objective, there is provided an ink refilling apparatus for a printer comprising: an ink cartridge; a refill cartridge having an ink supply outlet through which ink is supplied from the refill cartridge to the ink cartridge; and means for applying pressure to the ink in the refill cartridge to increase a speed by which the ink is supplied from the refill cartridge to the ink cartridge.

Preferably, the means for applying pressure comprises a driving source having a rotary shaft, a driving clutch connected to the rotary shaft, a propeller rotatably supported within the refill cartridge, for providing pressure on the ink contained in the refill cartridge, and a driven clutch for transferring a driving force of the driving source to the propeller when the driven clutch is coupled with the driving clutch.

The invention is also directed to the combination of a refill cartridge and a printer, and the combination of a refill apparatus and a printer. The printer includes a main body having a hollow. A driving source is disposed within the main body, and a driving clutch is attached to a rotary shaft of the driving source. The driving clutch is coupled with the driven clutch when the case is received in the hollow. Also, a valve is disposed within the main body in fluid communication with the ink cartridge. The valve has a protrusion portion that punctures the puncturable seal at the same time that the case is received in the hollow.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENTS

Figure 1:
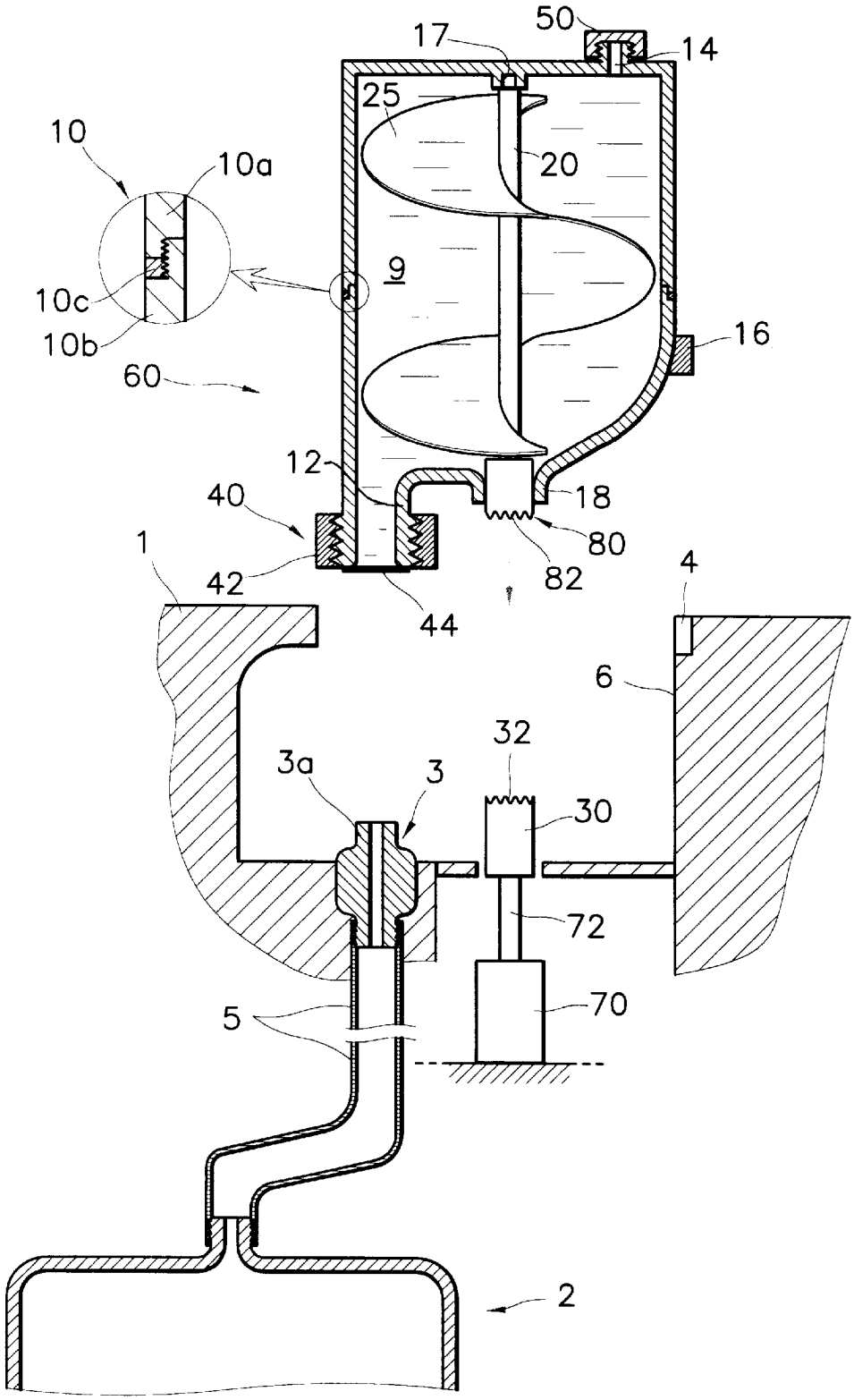
FIG. 1 shows the main portions of an ink refill apparatus according to a preferred embodiment of the present invention, before a refill cartridge is installed.

As shown in FIG. 1, in an ink refill apparatus for a printer according to a preferred embodiment of the present invention, an ink cartridge 2 is fixed to a s15 printer main body 1, and a refill cartridge 60 provides the ink cartridge 2 with ink via an ink supply outlet 12. In the printer main body 1, a hollow 6 is formed to/from which the refill cartridge 60 is attached/detached. Also, there is a rapid ink supply means for rapidly supplying ink from the refill cartridge 60 to the ink cartridge 2.

The rapid ink supply means includes a driving clutch 30 installed at the end of a rotary shaft 72 of a driving source 70 installed in the printer main body 1, a propeller 25 installed in the refill cartridge 60 and a driven clutch 80 coupled with the driving clutch 30.

In the hollow 6, a valve 3 and a color key hole 4 are formed, and the valve 3 is connected to the ink cartridge 2 via a path 5.

Figure 2:
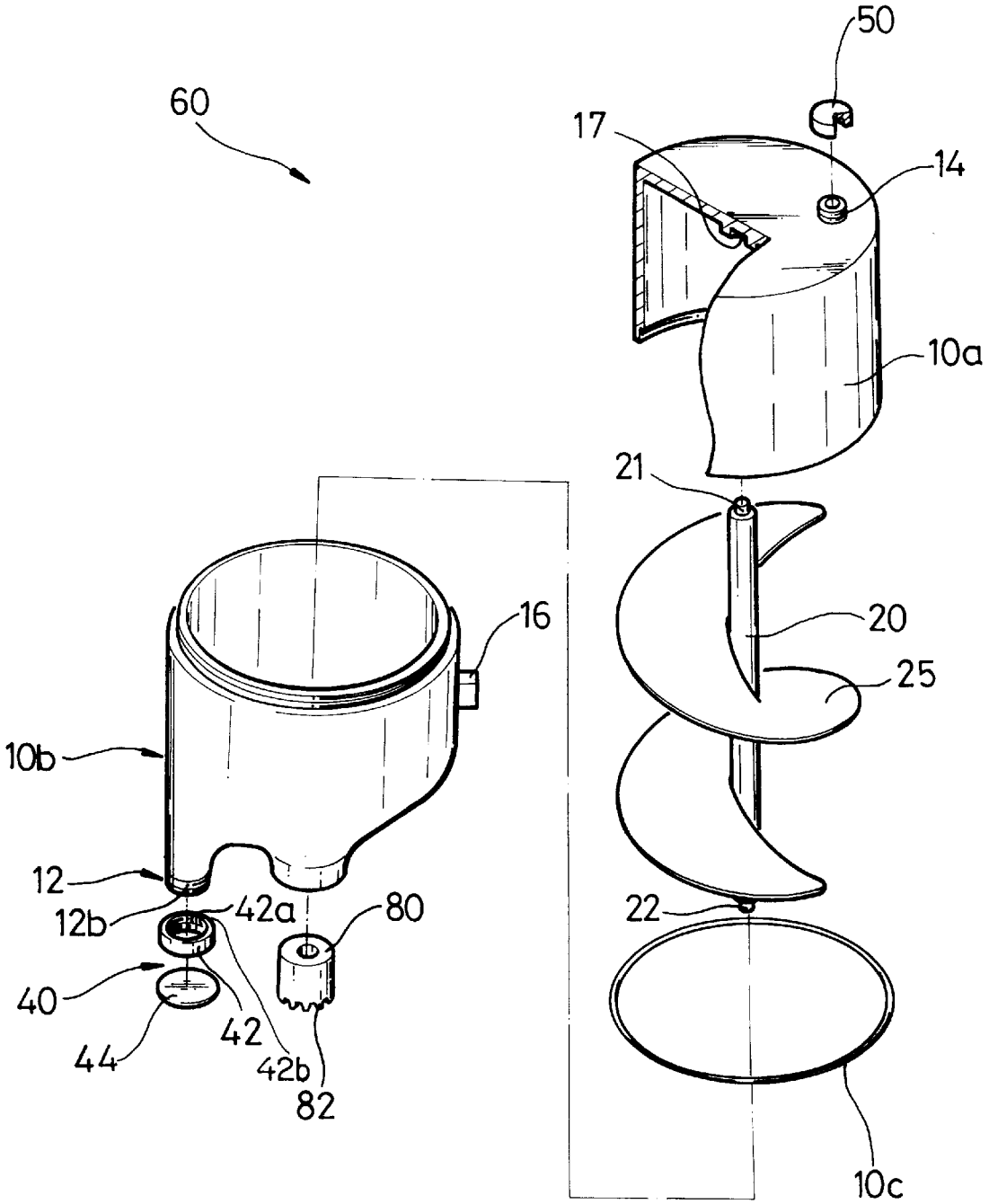
FIG. 2 is an exploded perspective view of the refill cartridge shown in FIG. 1.

Referring to FIG. 2, the refill cartridge 60 has a case 10 having an ink supply outlet 12 for supplying the ink cartridge 2 with ink. In the case 10, an air hole 14 is formed on the top surface thereof. Also, a shaft 20 along which the propeller 25 is formed is installed in the case 10.

The case 10 includes a shaft driving means capable of rotating the shaft 20 when the case 10 is installed in the printer main body 1. The shaft driving means includes the driven clutch 80 installed at one end of the shaft 20 to be connected with the driving clutch 30 coupled to the driving source 70 installed in the printer main body 1.

In the case 10, an upper case 10*a* and a lower case 10*b* are coupled after being manufactured separately so as to install the shaft 20 and the propeller 25 therein. The upper and lower cases 10*a* and 10*b* are coupled while a washer (O-ring) 10*c* is interposed therebetween.

A color key 16 is installed outside the case 10. The color key 16 has a color selecting function such that the color ink corresponding to the color key 16 is provided to the corresponding ink cartridge when a color printer uses a refill cartridge. That is, if the refill cartridge is seated on the hollow 6, the color key 16 is inserted into the corresponding key hole 4 (see FIG. 1), so the color of ink contained in the case 10 is automatically recognized.

One end 21 of the shaft 20 is inserted into an inserting hole 17 in the upper case 10*a,* and the other end 22 thereof is connected to the driven clutch 80.

The propeller 25 is a spiral member which is installed along the circumference of the shaft 20, for discharging ink contained in the case 10 to an ink supply outlet 12 while rotating together with the shaft 20.

The driven clutch 80 is coupled with the driving clutch 30 when the case 10 is installed in the hollow 6, in order to transfer a driving force of the driving source 70 to the shaft 20. The driving clutch 30 and the driven clutch 80 have gears 32 and 82 at each contact surface thereof, so that the driving force is transferred by engagement of two gears 32 and 82. However, the contact structure between the driving clutch 30 and the driven clutch 80 is not limited to the above, and any structure capable of transferring the driving force from the driving clutch 30 to the driven clutch 80, e.g., members having rough surfaces to increase frictional resistance to each other, can be adopted.

An ink supply outlet plug 40 seals the ink supply outlet 12 to facilitate handling of the refill cartridge before it is installed in the printer main body 1. When the sealed refill cartridge 60 is installed in the printer main body 1, the ink supply outlet plug 40 allows the ink to flow through the ink supply outlet 12, as described below.

The ink supply outlet plug 40 includes a coupling part 42 and a puncturable seal part 44. The coupling part 42 has a through hole 42*a* through which ink flows, and a screw portion (internal thread) 42*b* along the inner circumference thereof to be coupled with a screw portion 12*b* (external thread) formed along the outer circumference of the ink supply outlet 12.

The puncturable seal part 44 is attached to the coupling part 42 to seal the through hole 42*a,* and allows ink to flow through the ink supply outlet 12 by being punctured by a protrusion portion 3*a* of the valve 3 at the same time the case 10 is installed in the hollow 6. Thus, the puncturable seal part 44 is formed, for example, of a thin film, soft rubber or perforated film. The puncturable seal part 44 can be directly attached to the ink supply outlet 12 using adhesives, so that the coupling part 42 is not necessary.

An air hole plug 50 can be used to plug the air hole 14 and is detachable. The air hole plug 50 prevents discharge of ink via the air hole before the refill cartridge 60 is seated on the printer main body 1, and is then opened after the refill cartridge 60 is seated on the printer main body 1.

The ink refill apparatus for a printer having the above structure operates as follows.

When the refill cartridge 60 filled with ink is installed in the hollow 60, the color key 16 is inserted into the key hole 4, and the protrusion portion 3*a* of the valve 3 is inserted into the ink supply outlet 12. Also, the driven clutch 80 is coupled with the driving clutch 30. The protrusion portion 3*a* of the valve 3 runs through the puncturable seal part 44 to be inserted into the ink supply outlet 12, so that the ink supply hole 12 and the valve 3 are in fluid communication with each other.

Figure 3:
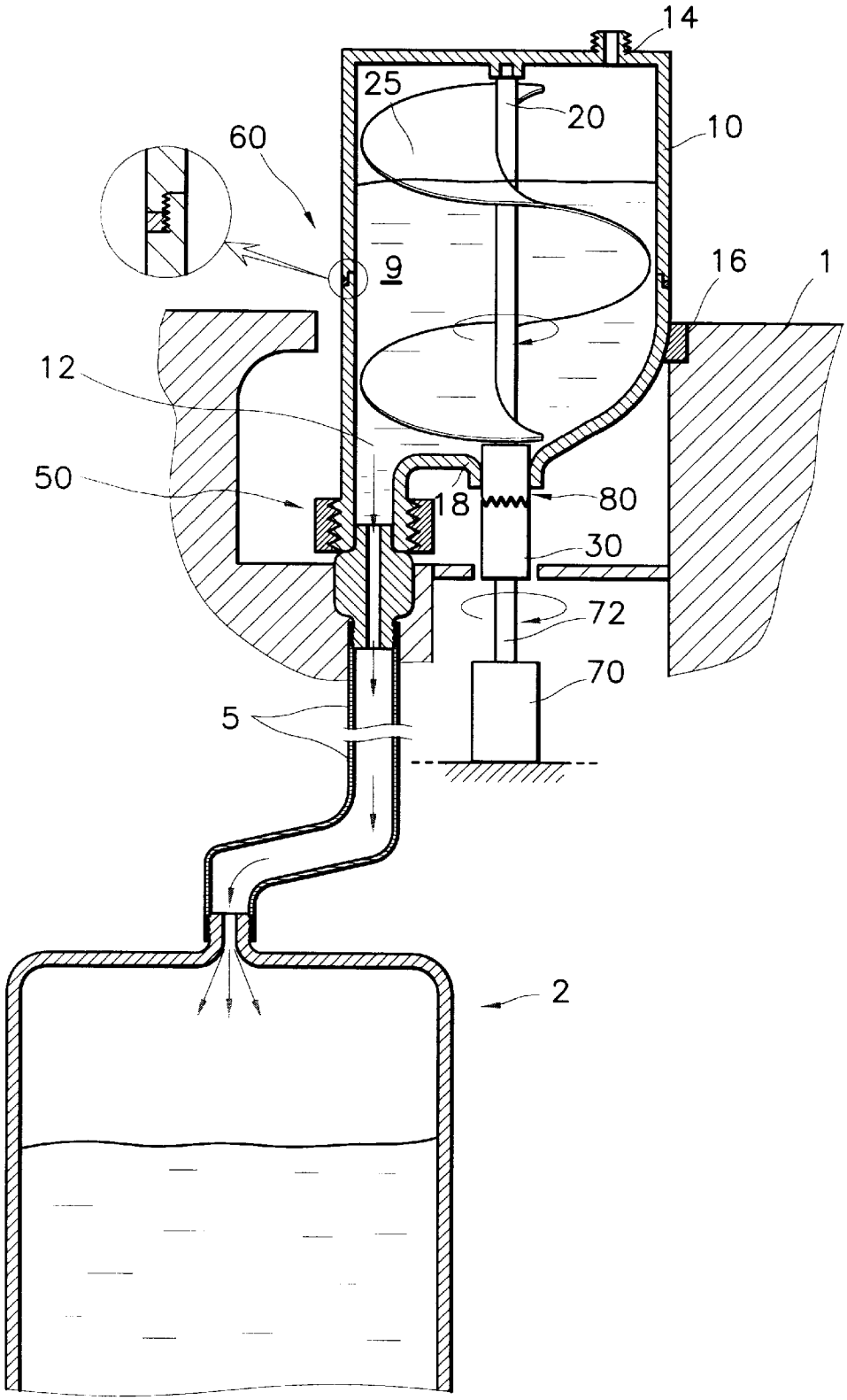
FIG. 3 is a diagram showing the supply of ink from the refill cartridge after being installed in a printer.

As shown in FIG. 3, when removing the air hole plug 50 from the air hole 14, ink contained in the case 10 flows into the ink cartridge 2 through the valve 3 and the path 5. The driving clutch 30 and the driven clutch 80, which are engaged with each other, are rotated by driving the driving source 70, and the propeller 25 installed along the shaft 20 rotates within the case 10. As a result, the propeller 25 applies a predetermined pressure to the ink 9 contained in the case 10 so that the ink 9 is rapidly supplied to the ink cartridge 2.

As described above, because ink is rapidly supplied to the ink cartridge installed in the printer main body, the wait time for refilling the ink cartridge with ink is reduced.

What is claimed is:

1. A refill cartridge for a printer comprising:

a case having an ink supply outlet and an air hole;

a shaft rotatably supported within said case;

a propeller installed on said shaft, for discharging ink contained in said case to said ink supply outlet;

means for rotating said shaft; and an ink supply outlet plug for opening and closing said ink supply outlet.

2. The refill cartridge of claim 1, wherein said means for rotating comprises a driven clutch connected to one end of said shaft.

3. The refill cartridge of claim 2, wherein said ink supply outlet plug comprises:

a coupling part coupled with said ink supply outlet; and a puncturable seal part attached to said coupling part.

4. The refill cartridge of claim 3, further comprising an air hole plug for opening and closing the air hole.

5. An ink refilling apparatus for a printer comprising:

an ink cartridge;

a refill cartridge having an ink supply outlet through which ink is supplied from said refill cartridge to said ink cartridge, and an air hole; and means for applying pressure to the ink in said refill cartridge to increase a speed by which the ink is supplied from said refill cartridge to said ink cartridge, wherein said means for applying pressure comprises:

a driving source having a rotary shaft;

a driving clutch connected to said rotary shaft;

a propeller rotatably supported within said refill cartridge, for providing pressure on the ink contained in said refill cartridge; and a driven clutch for transferring a driving force of said driving source to said propeller when said driven clutch is coupled with said driving clutch.

6. The ink refilling apparatus of claim 5, wherein said refill cartridge further comprises an input supply outlet plug for opening and closing said ink supply outlet.

7. The ink refilling apparatus of claim 6, wherein said ink supply outlet plug comprises:

a coupling part coupled with said ink supply outlet; and a puncturable seal part attached to said coupling part.

8. The ink refilling apparatus of claim 5, further comprising an air hole plug for opening and closing the air hole.

9. A refill cartridge in combination with a printer, comprising:

a printer main body having a hollow;

a case having an ink supply outlet and an air hole, the hollow in said printer main body being configured to receive said case;

a shaft rotatably supported within said case;

a propeller installed on said shaft, for discharging ink contained in said case to the ink supply outlet;

means for rotating said shaft when said case is received in said printer main body; and an ink supply outlet plug for opening and closing said ink supply outlet.

10. The combination refill cartridge and printer of claim 9, wherein said means for rotating comprises a driven clutch connected to one end of said shaft, a driving source in said printer main body, said driving source having a rotating shaft and a driving clutch attached to said rotating shaft, said driving clutch being coupled with said driven clutch when said case is received in said hollow.

11. The combination refill cartridge and printer of claim 10, wherein said ink supply outlet plug comprises:

a coupling pa rt coupled with said ink supply outlet; and a puncturable seal part attached to said coupling part for opening said ink supply outlet at the same time that said case is received in the hollow.

12. The combination refill cartridge and printer of claim 11, further comprising a valve having a protrusion portion, said valve being disposed within said main body at a position such that said protrusion portion punctures said puncturable seal at the same time that said case is received in the hollow.

13. An ink refilling apparatus in combination with a printer, comprising:

a printer main body having a hollow;

an ink cartridge disposed within said main body;

a refill cartridge removably received in the hollow, said refill cartridge having an ink supply outlet through which ink is supplied from said refill cartridge to said ink cartridge, and an air hole; and means for applying pressure to the ink in said refill cartridge to increase a speed by which the ink is supplied from said refill cartridge to said ink cartridge, wherein said means for applying pressure comprises:

a driving source having a rotary shaft, said driving source being disposed within said main body;

a propeller rotatably supported within said refill cartridge, for providing pressure on the ink contained in said refill cartridge; and a driven clutch for transferring a driving force of said driving source to said propeller when said driven clutch is coupled with said driving clutch.

14. The combination ink refilling apparatus and printer of claim 13, wherein said refill cartridge further comprises an input supply outlet plug for opening and closing said ink supply outlet.

15. The combination ink refilling apparatus and printer of claim 14, wherein said ink supply outlet plug comprises:

a coupling part coupled with said ink supply outlet; and a puncturable seal part attached to said coupling part for opening said ink supply outlet at the same time that said refill cartridge is received in said main body.

16. The combination ink refilling apparatus and printer of claim 13, further comprising an air hole plug for opening and closing the air hole.

17. The combination refill apparatus and printer of claim 15, further comprising a valve in fluid communication with said ink cartridge and having a protrusion portion, said valve being disposed within said main body at a position such that said protrusion portion punctures said puncturable seal at the same time that said case is received in the hollow.

* * * * *